US010269304B2

(12) United States Patent
Guo et al.

(10) Patent No.: US 10,269,304 B2
(45) Date of Patent: Apr. 23, 2019

(54) METHOD AND DEVICE FOR DRIVING LIQUID CRYSTAL DISPLAY PANEL

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventors: Xingling Guo, Guangdong (CN); Taisheng An, Guangdong (CN)

(73) Assignees: Shenzhen China Star Optoelectronics Technology Co., Ltd., Shenzhen, Guangdong (CN); Wuhan China Star Optoelectronics Technology Co., Ltd., Wuhan, Hubei (CN)

( * ) Notice: Subject to any disclaimer, the term of this patent is extended or adjusted under 35 U.S.C. 154(b) by 178 days.

(21) Appl. No.: 14/778,306

(22) PCT Filed: Apr. 13, 2015

(86) PCT No.: PCT/CN2015/076461
§ 371 (c)(1),
(2) Date: Dec. 6, 2016

(87) PCT Pub. No.: WO2016/155034
PCT Pub. Date: Oct. 6, 2016

(65) Prior Publication Data

US 2017/0103713 A1 Apr. 13, 2017

(30) Foreign Application Priority Data

Mar. 27, 2015 (CN) ..... 2015 1 0140222

(51) Int. Cl.
*G09G 3/34* (2006.01)
*G09G 3/20* (2006.01)
*G09G 3/36* (2006.01)

(52) U.S. Cl.
CPC ..... *G09G 3/3413* (2013.01); *G09G 3/2003* (2013.01); *G09G 3/3607* (2013.01);
(Continued)

(58) Field of Classification Search
CPC ..... G09G 3/3607; G09G 3/34; G09G 3/36; G09G 3/20; G09G 2300/0452;
(Continued)

(56) References Cited

U.S. PATENT DOCUMENTS 7,277,075 B1 * 10/2007 Hirano ..... G09G 3/3607 345/690
8,232,944 B2 * 7/2012 Takada ..... G09G 3/3406 345/589

(Continued)

*Primary Examiner* — Vijay Shankar
(74) *Attorney, Agent, or Firm* — Mintz Levin Cohn Ferris Glovsky and Popeo, P.C.; Kongsik Kim

(57) ABSTRACT

Disclosed is a method and a device for driving a liquid crystal display panel. The method comprises the following steps. A first pixel signal of an image to be displayed is converted to a second pixel signal. An adjusted gray scale of each of sub-pixels and/or an adjusted backlight brightness of a backlight is acquired based on the second pixel signal and the first pixel signal. Each of the sub-pixels in the liquid crystal display panel is driven so that each of the sub-pixels can have a corresponding adjusted gray scale, and/or, the backlight is activated so that the backlight can have the adjusted backlight brightness. With the driving device and the driving method, it is able to ensure that when the RGBW liquid crystal display panel displays a solid colored image, the brightness of the image will not be reduced.

10 Claims, 3 Drawing Sheets

(52) U.S. Cl.
CPC ..... *G09G 2300/0452* (2013.01); *G09G 2320/0233* (2013.01); *G09G 2320/0242* (2013.01); *G09G 2320/066* (2013.01); *G09G 2320/0646* (2013.01); *G09G 2360/16* (2013.01)

(58) Field of Classification Search
CPC ..... G09G 2320/0233; G09G 2320/066; G09G 3/3413; G09G 2320/0646; G09G 2360/16; G09G 3/2003; G09G 2320/0242
See application file for complete search history.

(56) References Cited

U.S. PATENT DOCUMENTS

| | | | | |
|---|---|---|---|---|
| 8,248,505 | B2 * | 8/2012 | Matsuda | H04N 5/357 348/333.11 |
| 8,314,761 | B2 * | 11/2012 | Takada | G09G 3/3406 345/589 |
| 8,314,820 | B2 * | 11/2012 | Kao | G09G 5/10 345/102 |
| 8,730,273 | B2 * | 5/2014 | Chu-Ke | G09G 3/3406 345/690 |
| 9,848,150 | B2 * | 12/2017 | Uchida | H04N 5/37455 |
| 2012/0249613 | A1 * | 10/2012 | Takada | G09G 3/3406 345/690 |

* cited by examiner

METHOD AND DEVICE FOR DRIVING LIQUID CRYSTAL DISPLAY PANEL

CROSS-REFERENCE TO RELATED APPLICATIONS

The present application claims benefit of Chinese patent application CN201510140222.8, entitled "Method and device for driving liquid crystal display panel" and filed on Mar. 27, 2015, the entirety of which is incorporated herein by reference.

TECHNICAL FIELD

The present disclosure relates to the technical field of liquid crystal display, and in particular, to a method and a device for driving a liquid crystal display panel.

TECHNICAL BACKGROUND

The existing liquid crystal display panels usually comprise three types of sub-pixels, namely, R (red), G (green), and B (blue) sub-pixels. The arrangement of these sub-pixels in a liquid crystal display panel is shown in FIG. 1, i.e., a pixel is composed of three sub-pixels (namely an R sub-pixel, a G sub-pixel, and a B sub-pixel).

With the development of liquid crystal display technologies, new ways of composing pixels and arranging sub-pixels, for example, RGBW arrangement, have been put forward. RGBW arrangement means that a pixel is composed of four sub-pixels. That is, besides the three traditional R, G, and B sub-pixels, a W pixel (white pixel) is added in a pixel. As shown in FIGS. 2, 3 and 4, there are various patterns of arranging the sub-pixels in an RGBW pixel. It can be seen from these figures that, due to the addition of a W pixel, images displayed by a screen of RGBW pixels appear to be brighter and fresher.

However, due to the addition of a W pixel in an RGBW pixel, with transmittances being the same and in display areas of a same size, a single sub-pixel will cover less proportion of the area of the image, which causes the screen to be less bright when a solid colored image is displayed, thereby failing to achieve a desirable display effect.

Specifically, providing that there are ⅓ R pixels, ⅓ G pixels, and ⅓ B pixels per unit area in a conventional RGB liquid crystal display panel, there will be ¼ R pixels, ¼ G pixels, ¼ B pixels, and ¼ W pixels per unit area in an RGBW liquid crystal display panel. Therefore, when a solid colored image is displayed, the image displayed by an RGBW liquid crystal display panel will have a lower brightness than that displayed by a conventional RGB liquid crystal display panel, thereby leading to a color shift of the displayed solid colored image, and affecting display effect.

SUMMARY OF THE INVENTION

The objective of the present disclosure is to overcome the defects that, according to existing methods of driving liquid crystal display panels, when the liquid crystal display panel displays a solid colored image, the screen thereof will become less bright, thus causing a color shift.

In order to solve the above technical problem, one embodiment of the present disclosure first provides a method for a driving liquid crystal display panel. The method comprises the following steps. A first pixel signal of an image to be displayed is converted to a second pixel signal. An adjusted gray scale of each of sub-pixels and/or an adjusted backlight brightness of a backlight is acquired based on the second pixel signal and the first pixel signal. Each of the sub-pixels in the liquid crystal display panel are driven so that each of the sub-pixels can have a corresponding adjusted gray scale, and/or, the backlight is activated so that the backlight can have the adjusted backlight brightness.

According to one embodiment of the present disclosure, the method further comprises a step of judging whether the image to be displayed is a solid colored image or not. If the image to be displayed is a non-solid colored image, an improved gray scale of each of the sub-pixels and a reduced backlight brightness of the backlight will be acquired based on the second pixel signal and the first pixel signal. And if the image to be displayed is a solid colored image, it will be judged, based on the second pixel signal and the first pixel signal, whether a preset display goal can be achieved by improving the gray scales of the sub-pixels, and the adjusted gray scale of each of sub-pixels and/or the adjusted backlight brightness of the backlight will be acquired based on a result of the judgment.

According to one embodiment of the present disclosure, if the preset display goal can be achieved by improving the gray scales of the sub-pixels, the improved gray scale of each of the sub-pixels will be acquired based on the second pixel signal and the first pixel signal. And if the preset display goal cannot be achieved by improving the gray scales of the sub-pixels, the improved gray scale of each of the sub-pixels and an improved backlight brightness of the backlight will be acquired based on the second pixel signal and the first pixel signal.

According to one embodiment of the present disclosure, if the image to be displayed is a solid colored image, a gray scale of the image to be displayed will be acquired based on the first pixel signal, and the gray scale of the image to be displayed will be matched with a preset gray scale range, and it will be judged whether the preset display goal can be achieved by improving the gray scales of the sub-pixels based on a match result.

According to one embodiment of the present disclosure, if the gray scale of the image to be displayed is within the preset gray scale range, it will be judged that the preset display goal cannot be achieved by improving the gray scales of the sub-pixels. Otherwise, it will be judged that the preset display goal can be achieved by improving the gray scales of the sub-pixels.

The present disclosure further provides a device for driving a liquid crystal display panel. The device comprises: a pixel signal conversion unit, for converting a first pixel signal of an image to be displayed to a second pixel signal; a data processing unit, which is connected to the pixel signal conversion unit, for acquiring, based on the second pixel signal and the first pixel signal, an adjusted gray scale of each of sub-pixels and/or an adjusted backlight brightness of a backlight; a pixel drive unit, which is connected to the data processing unit, for driving each of the sub-pixels based on the adjusted gray scale of the sub-pixels, so that each of the sub-pixels can have a corresponding adjusted gray scale; and a backlight control unit, which is connected to the data processing unit, for adjusting the working state of the backlight based on the adjusted backlight brightness, so that the backlight can have the adjusted backlight brightness.

According to one embodiment of the present disclosure, the data processing unit is also used to judge whether the image to be displayed is a solid colored image or not. If the image to be displayed is a non-solid colored image, the data processing unit will acquire, based on the second pixel signal and the first pixel signal, an improved gray scale of each of the sub-pixels and a reduced backlight brightness of the backlight. And if the image to be displayed is a solid colored image, the data processing unit, based on the second pixel signal and the first pixel signal, will judge whether a preset display goal can be achieved by improving the gray scales of the sub-pixels, and will acquire the adjusted gray scale of each of sub-pixels and/or the adjusted backlight brightness of the backlight based on a result of the judgment.

According to one embodiment of the present disclosure, if the preset display goal can be achieved by improving the gray scales of the sub-pixels, the data processing unit will acquire the improved gray scale of each of the sub-pixels based on the second pixel signal and the first pixel signal. And if the preset display goal cannot be achieved by improving the gray scales of the sub-pixels, the data processing unit will acquire the improved gray scale of each of the sub-pixels and an improved backlight brightness of the backlight based on the second pixel signal and the first pixel signal.

According to one embodiment of the present disclosure, if the image to be displayed is a solid colored image, the data processing unit will acquire a gray scale of the image to be displayed based on the first pixel signal, and match the gray scale of the image to be displayed with a preset gray scale range, and judge whether the preset display goal can be achieved by improving the gray scales of the sub-pixels based on a match result.

According to one embodiment of the present disclosure, if the gray scale of the image to be displayed is within the gray scale range, the data processing unit will judge that the preset display goal cannot be achieved by improving the gray scales of the sub-pixels. Otherwise, the data processing unit will judge that the preset display goal can be achieved by improving the gray scales of the sub-pixels.

The device for driving a liquid crystal display device according to the present disclosure is configured by adding the pixel signal conversion unit, the data processing unit, and the backlight control unit in the traditional display driving structure (either in a T-Con unit, or outside a T-Con unit). The pixel signal conversion unit is used to convert an input first pixel signal (e.g., an RGB signal) to a second pixel signal (e.g., an RGBW signal). The data processing unit prejudges whether an input image data indicates a solid colored image, and calculates the value of monochrome gray-scales and the amount of the backlight brightness of the backlight that should be varied when the image is intended to be displayed with a same display effect as displayed by a traditional RGB liquid crystal display panel. Then, the backlight control unit and the pixel drive unit in the liquid crystal display panel will be able to drive the backlight and the sub-pixels in the array substrate accordingly based on the above calculation results.

With the driving device and the driving method, it is able to ensure that when an RGBW liquid crystal display panel displays a solid colored image, the image will not become less bright compared with when it is displayed by the existing RGB liquid crystal display panels, thus avoiding a color shift and improving the display effect of RGBW liquid crystal display panels.

Other features and advantages of the present disclosure will be further explained in the following description, and will partly become self-evident therefrom, or be understood through the implementation of the present disclosure. The objectives and advantages of the present disclosure will be achieved through the structures specifically pointed out in the description, claims, and the accompanying drawings.

BRIEF DESCRIPTION OF THE DRAWINGS

For further illustrating the technical solutions provided in the embodiments of the present disclosure or in the existing technologies, a brief introduction will be given below to the accompanying drawings involved in describing the embodiments or the existing technologies.

DETAILED DESCRIPTION OF THE EMBODIMENTS

The present disclosure will be explained in detail with reference to the embodiments and the accompanying drawings, so as to fully understand how to solve the technical problem and achieve the technical effects by the technical means according to the present disclosure, and thus implement the same. It should be noted that as long as there is no structural conflict, any of the embodiments and any of the technical features thereof may be combined with one another, and the technical solutions obtained therefrom all fall within the scope of the present disclosure.

In addition, the details of following description are intended to illustrate the present disclosure so that the present disclosure can be understood thoroughly. It should be noted that the implementation of the present disclosure is not restricted to the details and particular methods described herein.

In the existing technologies, when a solid colored image is displayed, with same gray scale data of the image being input, the image displayed by an RGBW liquid crystal display panel will have a lower brightness than that displayed by a traditional RGB liquid crystal display panel, which causes color shift of the displayed image and further affects visual effects. Directed against the above technical problem, the present disclosure provides a new device and a new method for driving a liquid crystal display panel, which enables a solid colored image displayed by an RGBW liquid crystal display panel to have a same brightness and same display effect as displayed by a traditional RGB liquid crystal display panel, thus adding a strength to the RGBW liquid crystal display panel.

Figure 1:
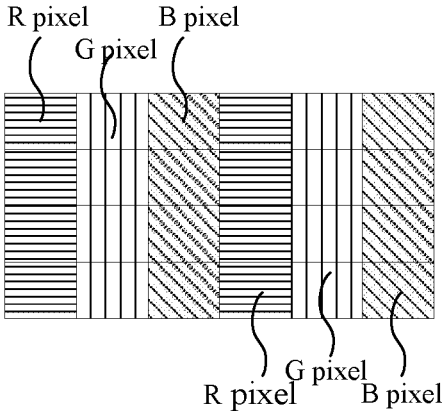
FIG. 1 schematically shows an arrangement of sub-pixels of existing RGB liquid crystal display panels.
Figure 2:
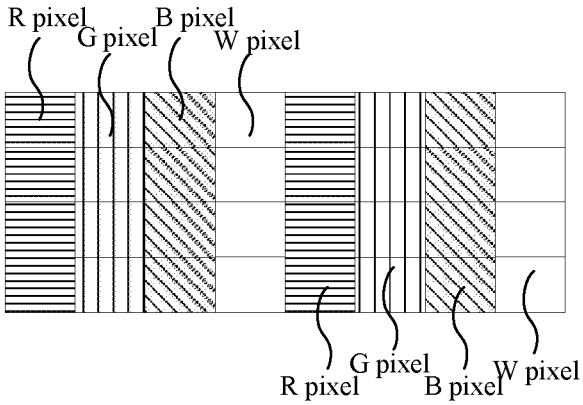
FIGS. 2 to 4 schematically show arrangements of sub-pixels of existing RGBW liquid crystal display panels.
Figure 3:
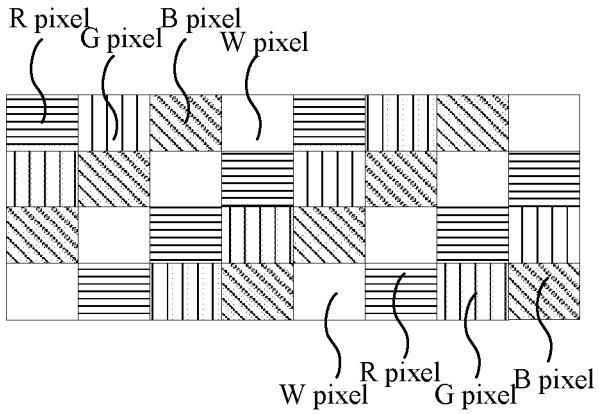
Figure 4:
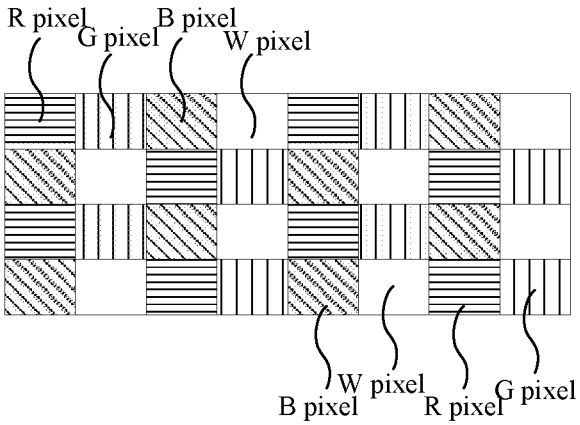
Figure 5:
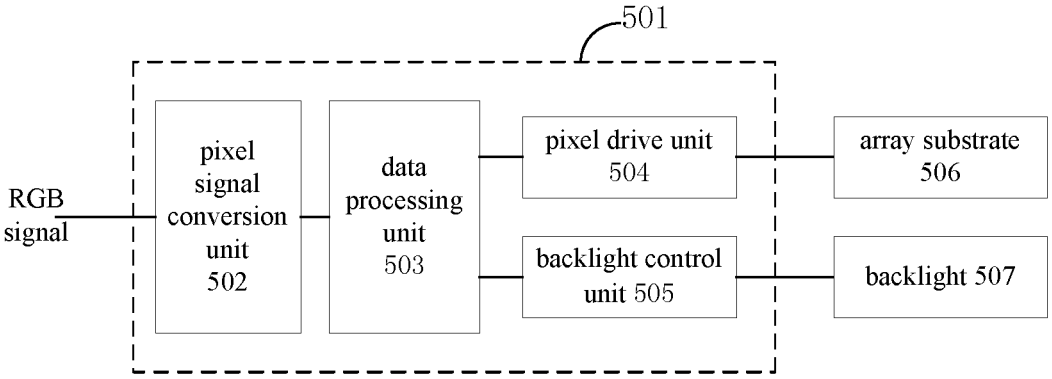
FIG. 5 schematically shows structure of a device for driving a liquid crystal display panel according to one embodiment of the present disclosure.

FIG. 5 schematically shows the structure of a device for driving a liquid crystal display panel according to the present embodiment.

As shown in FIG. 5, the device 501 for driving a liquid crystal display panel according to the present embodiment comprises a pixel signal conversion unit 502, a data processing unit 503, a pixel drive unit 504, and a backlight control unit 505. The pixel signal conversion unit 502 is able to convert a received first pixel signal of an image to be displayed to a second pixel signal, and transmit the obtained second pixel signal to the data processing unit 503, so that the second pixel signal can be further processed and analyzed by the data processing unit 503.

In the present embodiment, the liquid crystal display panel is an RGBW liquid crystal display panel, and the input pixel signal (i.e., the first pixel signal) is an RGB signal. Hence, the pixel signal conversion unit 502 converts the RGB signal of the image to be displayed to the RGBW signal (i.e., the second pixel signal). It should be noted that, in other embodiments of the present disclosure, the first pixel signal and/or the second pixel signal can also be other suitable signals. For example, in one embodiment of the present disclosure, the second pixel signal is an RGBY signal. The present disclosure would not be restricted in this regard.

The data processing unit 503 is connected to the pixel signal conversion unit 502, and acquires, based on the first pixel signal and the second pixel signal, an adjusted gray scale of each of sub-pixels and an adjusted backlight brightness of a backlight. The pixel drive unit 504 is connected to the data processing unit 503, and is able to adjust, based on the adjusted gray scales of the sub-pixels, a voltage applied on each of the sub-pixels in an array substrate 506, so that the gray scale of each of the sub-pixels in the liquid crystal display panel can become a corresponding adjusted gray scale of each of the sub-pixels achieved by the processing of the data processing unit 504. The backlight control unit 505 is also connected to the data processing unit 503, and is able to adjust the working state of the backlight 507 based on the adjusted backlight brightness achieved by the data processing unit 503, so that the backlight can have a required brightness (i.e., the adjusted backlight brightness).

In the present embodiment, the data processing unit 503 can judge whether the image to be displayed is a solid colored image or not based on the received first pixel signal (i.e., the RGB signal). Specifically, the data processing unit 503 determines whether the image to be displayed is a solid colored image or not by judging whether data in the RGB signal used for characterizing the gray scale of each of the sub-pixels remain unchanged or not. In a certain frame of the RGB signal, if each of the data characterizing a preset data size of the gray scale of each of the sub-pixels keeps unchanged, the data processing unit 503 will judge that the image to be displayed is a solid colored image. Otherwise, the data processing unit 503 will judge that the image to be displayed is a non-solid colored image.

It should be noted that, in other embodiments of the present disclosure, the data processing unit is able to judge whether the image to be displayed is a solid colored image or not by other reasonable means, and the present disclosure would not be restricted in this regard. For example, in other embodiments of the present disclosure, the data processing unit is able to judge whether the image to be displayed is a solid colored image or not based on the second pixel signal or based on a combination of the first pixel signal and the second pixel signal.

If the image to be displayed is a non-solid colored image, the data processing unit 503 will acquire, based on the second pixel signal and the first pixel signal, an improved gray scale of each of the sub-pixels and a reduced backlight brightness of the backlight. The signal drive unit 504 exerts a voltage on each of the sub-pixels in the array substrate 506 based on the improved gray scale of each of the sub-pixels transmitted from the data processing unit 503, so that each of the sub-pixels can have a gray scale as required. The backlight control unit 505 adjusts the backlight 507 based on the reduced backlight brightness of the backlight transmitted from the data processing unit, so that the backlight 507 can have said backlight brightness.

According to traditional driving methods, if an image of 50% brightness is required to be displayed, the backlight has to be kept bright, i.e., power consumption of the backlight is 100%, and the display effect of the 50% brightness will be achieved by a 50% gray scale of the sub-pixels. To put simply, according to the traditional driving methods, images of different brightness are displayed by providing a backlight brightness higher than actually required and then adjusting the gray scale of each of the sub-pixels in the array substrate. However, when over-bright images are displayed, this type of driving method easily causes problems such as eye strain, loss of details of dark images, etc., thereby leading to poor contrast ratio and a waste of electricity.

According to the driving device and the driving method provided in the present disclosure, the liquid crystal display panel is driven by improving the gray scales of the sub-pixels and reducing the brightness of the backlight (e.g., adjusting the brightness of the backlight to a 70% brightness). The method is able to achieve a brightness the same as or even higher than the traditional driving method, and meanwhile reduce power consumption of the liquid crystal display panel, thereby saving electricity and improving contrast ratio.

It should be noted that, in other embodiments of the present disclosure, non-solid colored images can also be driven through other suitable methods, and the present disclosure would not be restricted in this regard. For example, in other embodiments of the present disclosure, if required, the liquid crystal display panel can also be driven by traditional driving methods so as to display non-solid colored images.

If the image to be displayed is a solid colored image, the data processing unit 503, based on the second pixel signal and the first pixel signal, will judge whether a preset display goal (i.e., achieving the gray scale of the image to be displayed) can be achieved by improving the gray scales of the sub-pixels, and will acquire, based on a result of the judgment, the adjusted gray scale of each of sub-pixels and/or the adjusted backlight brightness of the backlight.

Specifically, in the present embodiment, the data processing unit 503 obtains a gray scale corresponding to the first pixel signal (i.e., the gray scale of the image to be displayed) based on the first pixel signal (i.e., the RGB signal), and also obtains a gray scale corresponding to the second pixel signal based on the second pixel signal (i.e., the RGBW signal). When a solid colored image is displayed, the image displayed by the second pixel signal has a lower brightness than the image displayed by the first pixel signal. Therefore, in order to increase the brightness of the image, the gray scales of the sub-pixels have to be improved. If the required brightness still cannot be achieved when the gray scales of the sub-pixels have been improved to full gray scales, it can be judged that the preset display goal cannot be achieved by improving the gray scales of the sub-pixels.

For example, providing that there are ⅓ R pixels, ⅓ G pixels, and ⅓ B pixels per unit area in a conventional RGB liquid crystal display panel, then there will be ¼ R pixels, ¼ G pixels, ¼ B pixels, and ¼ W pixels per unit area in an RGBW liquid crystal display panel. Therefore, with penetration rate and aperture ratio being the same, when a same solid colored image is displayed, the image displayed by an RGBW liquid crystal display panel will have a lower brightness than the image displayed by a conventional RGB liquid crystal display panel.

When input data of the display panel per unit area is an RGB signal corresponding to a red image with 180 gray scale, the traditional RGB liquid crystal display panel will, when displaying, switch off the green sub-pixels and blue sub-pixels in the unit area, and charge a voltage corresponding to the 180 gray scale into the red sub-pixels in the unit area in the display panel. In this case, the image displayed by the RGB liquid crystal display panel is a red image with ⅓ brightness and 180 gray scale.

However, for an RGBW liquid crystal display panel, an input RGB signal will be converted to an RGBW signal. When displaying, if based on the existing technical solution of display, the RGBW liquid crystal display panel will switch off the green sub-pixels and the blue sub-pixels in the unit area, and will charge the voltage corresponding to the 180 gray scale into the red sub-pixels in the unit area. In this case, the image displayed by the RGBW liquid crystal display panel is a red image with ¼ brightness and 180 gray scale.

Therefore, it can be concluded from the above that the solid colored image displayed by the RGBW liquid crystal display panel has a brightness of only ¾ of the desirable brightness, i.e., the brightness of the image is reduced. In order to achieve the desirable brightness, the driving device according to the present embodiment achieves the brightness of images by improving brightness of monochrome gray scales and/or backlight brightness.

However, if the gray scale of the image to be displayed is a solid colored one with high gray scale (e.g., a 248 gray scale) or a full gray scale (i.e., a 255 gray scale), images displayed by the second pixel signal may still fail to have the brightness of the image to be displayed even if the gray scale corresponding to the second pixel signal is improved to be a full gray scale.

It should be noted that, in other embodiments of the present disclosure, the data processing unit 503 can judge whether the preset display goal can be achieved by improving the gray scales of the sub-pixels by other reasonable means.

For example, in one embodiment of the present disclosure, the data processing unit can match the gray scale corresponding to the first pixel signal (namely the gray scale of the image to be displayed) with a preset gray scale range, and judge whether the preset display goal can be achieved by improving the gray scales of the sub-pixels based on a match result. Specifically, if the gray scale of the image to be displayed is within a preset gray scale range, it can be judged that the preset display goal cannot be achieved by improving the gray scales of the sub-pixels. The preset gray scale range corresponds to gray scale ranges of the solid colored high gray scale and the full gray scale. In different embodiments of the present disclosure, the preset gray scale range may vary according to different situations (e.g., in one embodiment of the present disclosure, the preset gray scale range is [190, 255]). The present disclosure is not restricted in this regard.

If the preset display goal can be achieved by improving the gray scales of the sub-pixels, the data processing unit 503 will determine an increment of gray scale corresponding to each of the sub-pixels based on the second pixel signal and the first pixel signal, and further determine the improved gray scale corresponding to each of the sub-pixels.

If the preset display goal cannot be achieved by improving the gray scales of the sub-pixels, the data processing unit 503 will determine the increment of gray scale corresponding to each of the sub-pixels and an increment of the backlight brightness based on the second pixel signal and the first pixel signal, and further determine the improved gray scales corresponding to each of the sub-pixels and the improved backlight brightness. In this case, even if the brightness of the image to be displayed cannot be achieved by improving the gray scale of sub-pixels, the insufficient brightness of the image can still be compensated by improving the backlight brightness when the image is displayed, thereby causing the image displayed by the RGBW liquid crystal display panel to have a brightness the same as the image displayed by an RGB liquid crystal display panel.

It should be noted that, in other embodiments of the present disclosure, the data processing unit can also enable the brightness of the RGBW liquid display panel to reach to a degree as required by other reasonable means. The present disclosure is not restricted in this regard. For example, in one embodiment of the present disclosure, the required display effect can also be achieved by merely increasing the backlight brightness of the backlight without improving the gray scales of sub-pixels, which will simplify the driving procedure of the liquid crystal display panel, thereby improving drive efficiency.

It can be seen from the above that the device for driving a liquid crystal display device according to the present disclosure is configured by adding the pixel signal conversion unit, the data processing unit, and the backlight control unit in the traditional display driving structure (either in a T-Con unit, or outside a T-Con unit). The pixel signal conversion unit is used to convert the input first pixel signal (e.g., a RGB signal) to the second pixel signal (e.g., a RGBW signal). The data processing unit prejudges whether the input image data indicates a solid colored image, and calculates the value of monochrome gray-scales and the amount of the backlight brightness of the backlight that should be varied when the image is intended to be displayed with a same effect as displayed by a conventional RGB liquid crystal display panel. Then, the backlight control unit and the pixel drive unit in the liquid crystal display panel drive the backlight and the sub-pixels in an array substrate accordingly based on the above calculation results.

With the driving device, it is able to ensure that when an RGBW liquid crystal display panel displays a solid colored image, the image will not become less bright compared with when it is displayed by the existing RGB liquid crystal display panels, thus avoiding a color shift and improving the display effect of RGBW liquid crystal display panels.

Figure 6:
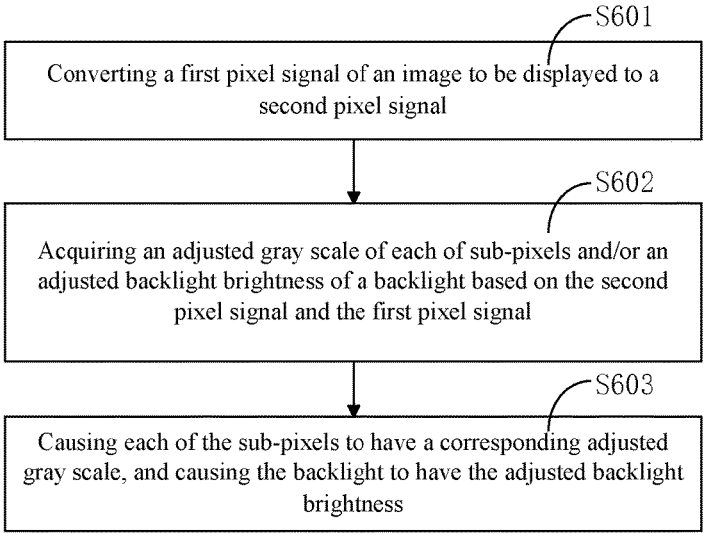
FIG. 6 shows a flow chart of a method for driving a liquid crystal display panel according to one embodiment of the present disclosure.

FIG. 6 shows a flow chart of a method for driving a liquid crystal display panel according to the present embodiment.

As shown in FIG. 6, according to the method for driving a liquid crystal display panel provided in the present embodiment, in step S601, a received first pixel signal of an image to be displayed is converted into a second pixel signal.

In the present embodiment, the liquid crystal display panel is an RGBW liquid crystal display panel, and the input pixel signal (namely the first pixel signal) is an RGB signal. Therefore, the second pixel signal obtained in step S601 is an RGBW signal. It should be noted that, in other embodiments of the present disclosure, the first pixel signal and/or the second pixel signal can also be other suitable signals. For example, in one embodiment of the present disclosure, the second pixel signal is an RGBY signal. The present disclosure is not restricted in this regard.

In step S602, an adjusted gray scale of each of sub-pixels and an adjusted backlight brightness of a backlight are acquired based on the first pixel signal and the second pixel signal. In step S603, a voltage applied on each of the sub-pixels in the array substrate is adjusted according to the adjusted gray scale, so that the gray scale of each of the sub-pixels in the liquid crystal display panel may become the corresponding adjusted gray scale obtained in step S602. Meanwhile, in step S603, the working state of the backlight in the liquid crystal display panel is controlled based on the adjusted backlight brightness obtained in step S602, so that the backlight can have a brightness as required (i.e., the adjusted backlight brightness).

Figure 7:
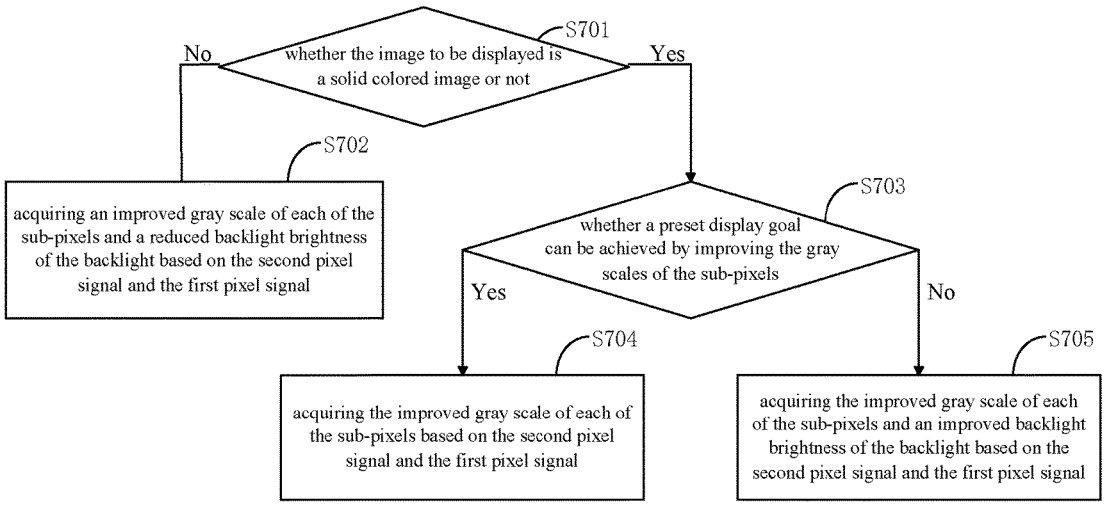
FIG. 7 shows a flow chart of determining an adjusted gray scale and an adjusted backlight brightness.

As shown in FIG. 7, in the present embodiment, in the procedure of determining the adjusted gray scale of each of the sub-pixels and/or the adjusted backlight brightness of the backlight, it is judged also in step S701 whether the image to be displayed is a solid colored image or not based on the received first pixel signal (namely the RGB signal). Specifically, in step S701, whether the image to be displayed is a solid colored image or not is determined by judging whether data in the RGB signal used for characterizing the gray scale of each of the sub-pixels remain unchanged or not. In a certain frame of RGB signal, if each of the data characterizing a preset data size of the gray scale of each of the sub-pixels keeps unchanged, it will be judged that the image to be displayed is a solid colored image. Otherwise, it will be judged that the image to be displayed is a non-solid colored image.

It should be noted that, in other embodiments of the present disclosure, whether the image to be displayed is a solid colored image or not can also be judged by other reasonable means. The present disclosure would not be restricted in this regard. For example, in other embodiments of the present disclosure, whether the image to be displayed is a solid colored image or not can also be judged based on the second pixel signal or based on a combination of the first pixel signal and the second pixel signal.

If the image to be displayed is a non-solid colored image, in step S702, an improved gray scale of each of the sub-pixels and a reduced backlight brightness of the backlight will be acquired based on the second pixel signal and the first pixel signal. And in steps to be followed, a voltage will be applied on each of the sub-pixels based on the adjusted gray scale of each of the sub-pixels, and meanwhile, the brightness of the backlight is adjusted based on the reduced backlight brightness of the backlight so that the backlight can have the reduced backlight brightness obtained in step S702. The driving method is able to achieve a brightness the same as or even higher than the traditional driving method, and meanwhile reduce power consumption of the liquid crystal display panel, thereby saving electricity and improving contrast ratio.

It should be noted that, in other embodiments of the present disclosure, non-solid colored images can also be driven through other suitable methods. The present disclosure would not be restricted in this regard. For example, in other embodiments of the present disclosure, if required, the liquid crystal display panel can also be driven by the traditional driving methods so as to display non-solid colored images.

If the image to be displayed is a solid colored image, in step S703, it will be judged further whether a preset display goal can be achieved by improving the gray scales of the sub-pixels (i.e., achieving the gray scale of the image to be displayed) based on the second pixel signal and the first pixel signal, and the adjusted gray scale of each of sub-pixels and/or the adjusted backlight brightness of the backlight will be acquired based on a result of the judgment.

Specifically, in the present embodiment, a gray scale corresponding to the first pixel signal (i.e., the gray scale of the image to be displayed) is obtained based on the first pixel signal (i.e., the RGB signal), and a gray scale corresponding to the second pixel signal is also obtained based on the second pixel signal (i.e., the RGBW signal). When a solid colored image is displayed, the image displayed by the second pixel signal has a lower brightness than the image displayed by the first pixel signal. Therefore, in order to increase the brightness of the image, the gray scales of the sub-pixels have to be improved. If the required brightness still cannot be achieved when the gray scales of the sub-pixels have been improved to full gray scales, it can be judged that the preset display goal cannot be achieved by improving the gray scales of the sub-pixels.

However, if the gray scale of the image to be displayed is a solid colored one with high gray scale (e.g., a 248 gray scale) or a full gray scale (i.e., a 255 gray scale), images displayed by the second pixel signal may still fail to have the brightness of the image to be displayed even if the gray scale corresponding to the second pixel signal is improved to be a full gray scale.

It should be noted that, in other embodiments of the present disclosure, whether the preset display goal can be achieved by improving the gray scales of the sub-pixels can also be judged by other suitable means. The present disclosure would not be restricted in this regard.

For example, in one embodiment of the present disclosure, the data processing unit can match the gray scale corresponding to the first pixel signal with a preset gray scale range, and judge based on a match result, whether the preset display goal can be achieved by improving the gray scales of the sub-pixels. Specifically, if the gray scale of the image to be displayed is within the gray scale range, it can be judged that the preset display goal cannot be achieved by improving the gray scales of the sub-pixels. The preset gray scale range corresponds to gray scale ranges of the solid colored high gray scale and the full gray scale. In different embodiments of the present disclosure, the preset gray scale range may vary according to different situations (e.g., in one embodiment of the present disclosure, the preset gray scale range is [190, 255]). The present disclosure would not be restricted in this regard.

If the preset display goal can be achieved by improving the gray scales of the sub-pixels, in step S704, an increment of gray scale corresponding to each of the sub-pixels will be determined based on the second pixel signal and the first pixel signal, and the improved gray scale corresponding to each of the sub-pixels will be determined further.

If the preset display goal cannot be achieved by improving the gray scales of the sub-pixels, in step S705, the increment of gray scale corresponding to each of the sub-pixels and an increment of the backlight brightness will be determined based on the second pixel signal and the first pixel signal, and the improved gray scale corresponding to each of the sub-pixels and the improved backlight brightness will be determined further. In this case, even if the brightness of the image to be displayed cannot be achieved by improving the gray scale of sub-pixels, the insufficient brightness of the image can still be compensated by improving the backlight brightness when the image is displayed, thereby causing the image displayed by the RGBW liquid crystal display panel to have a brightness the same as the image displayed by an RGB liquid crystal display panel.

It should be noted that, in other embodiments of the present disclosure, the brightness of the RGBW liquid display panel can also be achieved to a degree as required by other suitable means. The present disclosure would not be restricted in this regard. For example, in one embodiment of the present disclosure, the required display effect can also be achieved by merely increasing the backlight brightness of the backlight without improving the gray scales of sub-pixels, which will simplify the driving procedure of the liquid crystal display panel, thereby improving drive efficiency.

Based on the above, the method for the driving liquid crystal display device according to the present embodiment can be summarized as follows. The input first pixel signal (e.g., the RGB signal) is converted to the second pixel signal (e.g., the RGBW signal). Then, it is judged whether the input image data indicates a solid colored image or not, and the value of monochrome gray-scales and the amount of the backlight brightness of the backlight that should be varied are calculated when the image is intended to be displayed with a same effect as displayed by a conventional RGB liquid crystal display panel. Finally, the sub-pixels in the array substrate and the backlight are driven based on the above calculation results.

With the driving method, it is able to ensure that when an RGBW liquid crystal display panel displays a solid colored image, the image will not become less bright compared with when it is displayed by the existing RGB liquid crystal display panels, thus avoiding a color shift and improving the display effect of RGBW liquid crystal display panels.

It should be noted that the embodiments disclosed herein are not limited by specific structures, treatment steps or materials disclosed herein, but incorporate the equivalent substitutes of these features which are comprehensible to those skilled in the art. It should also be noted that the technical terms used herein are used only for describing the specific embodiments, not for limiting them.

The expressions "one embodiment" or "embodiments" referred to herein mean that the specific features, structures and characteristics described in combination with the embodiments are contained in at least one embodiment of the present disclosure. Therefore, the expressions "one embodiment" or "embodiments" appeared in all parts of the whole description do not necessarily refer to the same embodiment.

For sake of convenience, a plurality of items, structural units, component units and/or materials used herein can be listed in a common list. However, the list will be understood in a way that each element thereof represents an only and unique member. Therefore, when there is no other explanation, none of members of the list can be understood as an actual equivalent of other members in the same list only based on the fact that they appear in the same list. In addition, the embodiments and examples of the present disclosure can be explained with reference to the substitutes of each of the components. It could be understood that, the embodiments, examples and substitutes herein shall not be interpreted as the equivalents of one another, but will be considered as separate and independent representatives of the present disclosure.

The embodiments are described hereinabove to interpret the principles of the present disclosure in one application or a plurality of applications. However, a person skilled in the art, without departing from the principles and thoughts of the present disclosure, can make various modifications to the forms, usages and details of the embodiments of the present disclosure without any creative work. Therefore, the protection scope of the present disclosure will be determined by the claims.

The invention claimed is:

1. A device for driving a liquid crystal display panel, comprising:

a pixel signal conversion unit, for converting a first pixel signal of an image to be displayed to a second pixel signal, a data processing unit, which is connected to the pixel signal conversion unit, for acquiring, based on the second pixel signal and the first pixel signal, an adjusted gray scale of each of sub-pixels and/or an adjusted backlight brightness of a backlight, a pixel drive unit, which is connected to the data processing unit, for judging whether the image to be displayed is a solid colored image or not, wherein if the image to be displayed is a non-solid colored image, the data processing unit will acquire, based on the second pixel signal and the first pixel signal, an improved gray scale of each of the sub-pixels and a reduced backlight brightness of the backlight, and if the image to be displayed is a solid colored image, the data processing unit will judge whether a preset display goal can be achieved by improving the gray scales of the sub-pixels based on the second pixel signal and the first pixel signal, and will acquire the adjusted gray scale of each of sub-pixels and/or the adjusted backlight brightness of the backlight based on a result of the judgment, a backlight control unit, which is connected to the data processing unit, for adjusting the working state of the backlight based on the adjusted backlight brightness, so that the backlight can have the adjusted backlight brightness.

2. The device according to claim 1, wherein, if the preset display goal can be achieved by improving the gray scales of the sub-pixels, the data processing unit will acquire the improved gray scale of each of the sub-pixels based on the second pixel signal and the first pixel signal, and if the preset display goal cannot be achieved by improving the gray scales of the sub-pixels, the data processing unit will acquire the improved gray scale of each of the sub-pixels and an improved backlight brightness of the backlight based on the second pixel signal and the first pixel signal.

3. The device according to claim 1, wherein, if the image to be displayed is a solid colored image, the data processing unit, based on the first pixel signal, will acquire a gray scale of the image to be displayed, and match the gray scale of the image to be displayed with a preset gray scale range, and judge, based on a match result, whether the preset display goal can be achieved by improving the gray scales of the sub-pixels.

4. The device according to claim 2, wherein, if the image to be displayed is a solid colored image, the data processing unit, based on the first pixel signal, will acquire the gray scale of the image to be displayed, and match the gray scale of the image to be displayed with a preset gray scale range, and judge, based on a match result, whether the preset display goal can be achieved by improving the gray scales of the sub-pixels.

5. The device according to claim 3, wherein, if the gray scale of the image to be displayed is within the gray scale range, the data processing unit will judge that the preset display goal cannot be achieved by improving the gray scales of the sub-pixels, and otherwise, the data processing unit will judge that the preset display goal can be achieved by improving the gray scales of the sub-pixels.

6. A method for driving a liquid crystal display panel, comprising steps of:

converting a first pixel signal of an image to be displayed to a second pixel signal, judging whether the image to be displayed is a solid colored image or not, wherein if the image to be displayed is a non-solid colored image, an improved gray scale of each of the sub-pixels and a reduced backlight brightness of the backlight will be acquired based on the second pixel signal and the first pixel signal, and if the image to be displayed is a solid colored image, it will be judged, based on the second pixel signal and the first pixel signal, whether a preset display goal can be achieved by improving the gray scales of the sub-pixels, and the adjusted gray scale of each of sub-pixels and/or the adjusted backlight brightness of the backlight will be acquired based on a result of the judgment, driving each of the sub-pixels in the liquid crystal display panel so that each of the sub-pixels can have a corresponding adjusted gray scale, and/or, activating the backlight so that the backlight can have the adjusted backlight brightness.

7. The method according to claim 6, wherein, if the preset display goal can be achieved by improving the gray scales of the sub-pixels, the improved gray scale of each of the sub-pixels will be acquired based on the second pixel signal and the first pixel signal, and if the preset display goal cannot be achieved by improving the gray scales of the sub-pixels, the improved gray scale of each of the sub-pixels and an improved backlight brightness of the backlight will be acquired based on the second pixel signal and the first pixel signal.

8. The method according to claim 6, wherein, if the image to be displayed is a solid colored image, a gray scale of the image to be displayed will be acquired based on the first pixel signal, and the gray scale of the image to be displayed will be matched with a preset gray scale range, and then it will be judged, based on a match result, whether the preset display goal can be achieved by improving the gray scales of the sub-pixels.

9. The method according to claim 7, wherein, if the image to be displayed is a solid colored image, the gray scale of the image to be displayed will be acquired based on the first pixel signal, and the gray scale of the image to be displayed will be matched with a preset gray scale range, and then it will be judged, based on the match result, whether the preset display goal can be achieved by improving the gray scales of the sub-pixels.

10. The method according to claim 8, wherein, if the gray scale of the image to be displayed is within the preset gray scale range, it will be judged that the preset display goal cannot be achieved by improving the gray scales of the sub-pixels, and otherwise, it will be judged that the preset display goal can be achieved by improving the gray scales of the sub-pixels.

* * * * *